US009205540B2

(12) United States Patent
Lin

(10) Patent No.: US 9,205,540 B2
(45) Date of Patent: Dec. 8, 2015

(54) ONE-WAY DRIVE STRAP WRENCH

(71) Applicant: Chao-Ching Lin, Taichung (TW)

(72) Inventor: Chao-Ching Lin, Taichung (TW)

( * ) Notice: Subject to any disclaimer, the term of this patent is extended or adjusted under 35 U.S.C. 154(b) by 198 days.

(21) Appl. No.: 14/075,065

(22) Filed: Nov. 8, 2013

(65) Prior Publication Data

US 2015/0128768 A1 May 14, 2015

(51) Int. Cl.
*B25B 13/52* (2006.01)
*B25B 27/00* (2006.01)

(52) U.S. Cl.
CPC ..... *B25B 13/52* (2013.01); *B25B 27/0042* (2013.01)

(58) Field of Classification Search
CPC ..... B25B 13/52; B25B 27/0042
See application file for complete search history.

(56) References Cited

U.S. PATENT DOCUMENTS 2,094,238 A * 9/1937 Koenig ..... B25B 1/205 81/65
6,196,090 B1 3/2001 Dumont
8,316,740 B2 * 11/2012 Idir ..... B25B 13/52 81/3.43

* cited by examiner

*Primary Examiner* — David B Thomas
(74) *Attorney, Agent, or Firm* — Rosenberg, Klein & Lee

(57) ABSTRACT

A one-way drive strap wrench has a handle, a threaded rod module mounted in the handle and a clamping module mounted in the handle. The clamping module has an asymmetric clamping block and a strap. The clamping block is mounted around a combining unit of the handle and has an accommodating trough accommodating a pushing segment of the threaded rod module, wherein the accommodating trough is wider than the pushing segment. The strap is circled around the clamping block to form a surrounded area. A crossing angle is formed between the axis of the handle and the blocking line and is smaller than 90 degrees.

7 Claims, 10 Drawing Sheets

ONE-WAY DRIVE STRAP WRENCH

BACKGROUND OF THE INVENTION

1. Field of the Invention

The present invention relates to a wrench, and more particularly to a one-way drive strap wrench.

2. Description of Related Art

A strap wrench is applied for turning a cylindrical object in one direction, for example, an oil filter of a motor vehicle, such that the strap wrench is not limited by surrounding engine parts of the oil filter in the motor vehicle.

With reference to U.S. Pat. No. 6,196,090, a conventional strap wrench has a handle, a strap and a torque-transmitting shoe. The strap is mounted on the handle to form a loop and to define two opposite strap portions. The two opposite strap portions cooperate with two zones. The torque-transmitting shoe is connected with the handle between the two zones.

In use, a position of an axis of the torque-transmitting shoe is offset relative to an axis of handle to change a tension of the strap. When the axis of the torque-transmitting shoe is closer to a first point (22A in the U.S. Pat. No. 6,196,090) than to a second point (22B in the U.S. Pat. No. 6,196,090), the strap is more taut. On the other hand, when the axis of the torque-transmitting shoe is closer to the second point than to the first point, the strap is less taut. Therefore, the tension of the strap can be changed depending on the desired tightness for clamping the oil filter.

However, the torque-transmitting shoe can be offset based on the axis of the torque-transmitting shoe relative to the handle by a spring mounted around the axis of the torque-transmitting shoe and a pin that protrudes from the torque-transmitting shoe and is slidable in a slot. However, the structure between the handle and the torque-transmitting shoe is complicated. The complicated structure may require a costly and time-consuming manufacturing process.

SUMMARY OF THE INVENTION

The main objective of the present invention is to provide a one-way drive strap wrench to resolve the mentioned problems.

The one-way drive strap wrench has a handle, a threaded rod module, a clamping module, a central connecting line, a blocking line, a first angle, and a second angle.

The handle is hollow and has an axis, an operating knob, and a combining unit. The operating knob is rotatably mounted on an end of the handle. The combining unit is mounted on the handle and located at a position on the handle opposite to the operating knob.

The threaded rod module is mounted in the handle and has a rod body and a nut. The rod body is elongated, is rotatably mounted in the handle and has a fixed segment, a pushing segment and a threaded segment. The fixed segment is mounted in the operating knob. The pushing segment is opposite to the fixed segment. The threaded segment is connected between the fixed segment and the pushing segment. The nut is moveably engaged with the threaded segment of the rob body via threads.

The clamping module is mounted on the handle and the threaded rod module and has a clamping block and a strap. The clamping block is meniscus, is deflectably mounted around the combining unit and has a convex side, a concave side, multiple sawteeth, and an accommodating trough. The convex side is convex and adjacent to the pushing segment. The concave side is concave and opposite to the convex side. The sawteeth are formed on the concave side. The accommodating trough is formed in the convex side, accommodates the pushing segment, and selectively abuts the pushing segment. The strap is combined with the nut, is circled around the clamping block and has a surrounded area formed between the convex side of the clamping block and the strap, wherein the surrounded area has a central point.

The central connecting line is defined as a connection that passes through the central point and a center of the combining unit.

The blocking line is defined as a connection that passes through two ends of the concave side.

The first angle is defined between the axis of the handle and the central connecting line.

The second angle is defined between the axis of the handle and the blocking line, wherein a sum of the first angle and the second angle is fixed.

Other objectives, advantages and novel features of the present invention will become more apparent from the following detailed description when taken in conjunction with the accompanying drawings.

DETAILED DESCRIPTION OF PREFERRED EMBODIMENT

Figure 1:
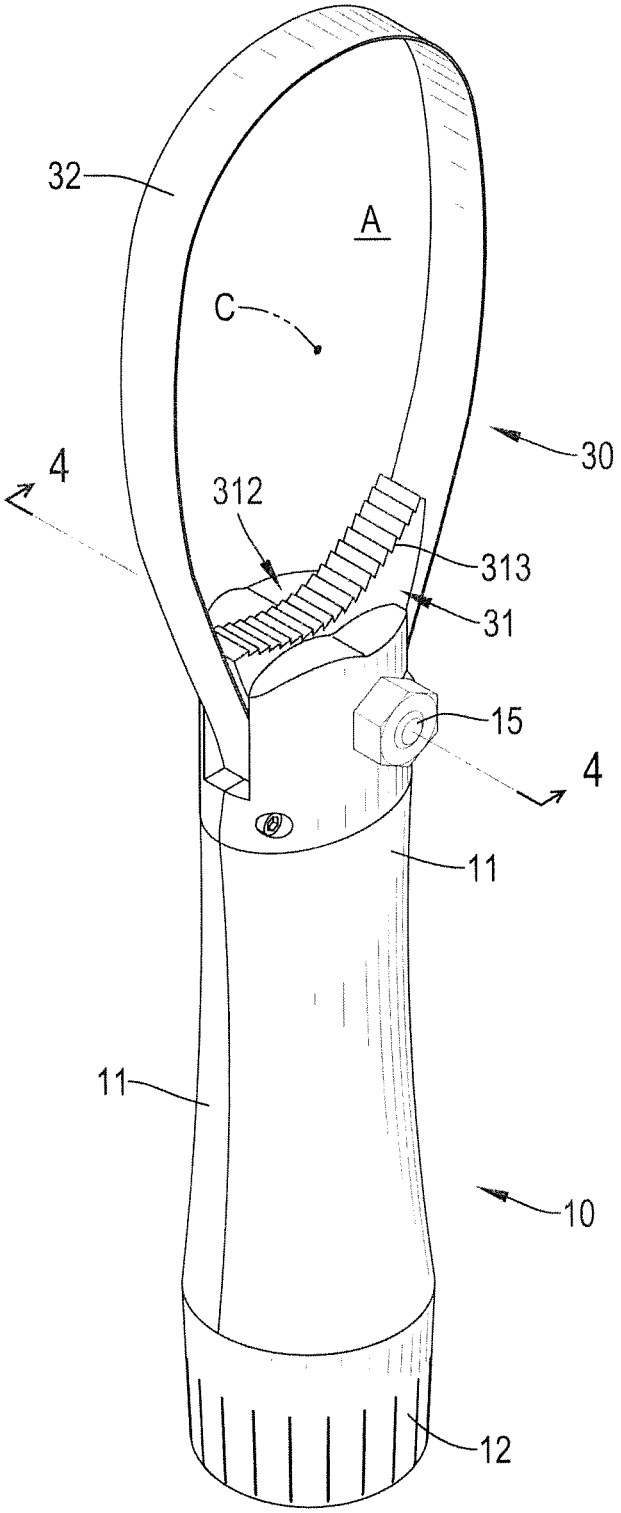
FIG. 1 is a perspective view of a preferred embodiment of a one-way drive strap wrench in accordance with the present invention.

With reference to FIGS. 1 to 5, a preferred embodiment of a one-way drive strap wrench in accordance with the present invention has a handle 10, a threaded rod module 20, and a clamping module 30.

The handle 10 has an axis L1, two handle plates 11, an operating knob 12, a fixing base 13, a mounting cover 14, and a combining unit 15. The handle plates 11 are curved elongated, and abut each other to form a handle space 16 between the handle plates 11. The operating knob 12 is rotatably connected with two ends of the handle plates 11 that abut each other. The fixing base 13 is formed on a side of one of the handle plates 11 and protrudes from the handle plate 11 toward the other handle plate 11. The fixing base 13 is hollow along the axis L1 of the handle 10. The mounted cover 14 is formed on a side of the other handle plate 11. The mounting cover 14 is U-shaped, abuts the fixing base 13 and is located at a side of the fixing base 13 opposite to the operating knob 12. The mounting cover 14 has an outer mounting portion 141 and an inner mounting portion 142. The inner mounting portion 142 protrudes from an interior of the outer mounting portion 141 and has an inner width W2 smaller than an inner width W1 of the outer mounting portion 141. The combining unit 15 is inserted through the handle plates 11 to combine and keep the handle plates 11 from detaching from each other. The combining unit 15 is located at a position on the handle plates 11 distal from the operating knob 12.

With reference to FIGS. 2, 3, 4, 6 and 6A, the threaded rod module 20 is detachably mounted in the handle 10 and has a rod body 21 and a nut 22. The rod body 21 is elongated, is rotatably mounted in the handle space 16 and has a fixed segment 211, a pushing segment 212, and a threaded segment 213. The fixed segment 211 is mounted in the operating knob 12. The pushing segment 212 is opposite to the fixed segment 211 and is inserted through the fixing base 13. The pushing segment 212 has a smaller diameter segment 214 and a larger diameter segment 215. The smaller diameter segment 214 is connected with the threaded segment 213 and is mounted in and abuts the inner mounting portion 142. The larger diameter segment 215 is connected with the smaller diameter segment 214, is mounted in the outer mounting portion 141, abuts the outer mounting portion 141 and the inner mounting portion 142 and is restricted by the inner mounting portion 142. The larger diameter segment 215 has a diameter D1. The threaded segment 213 is connected between the fixed segment 211 and the pushing segment 212. The nut 22 is moveably engaged with the threaded segment 213 of the rob body 21 via threads.

Figure 2:
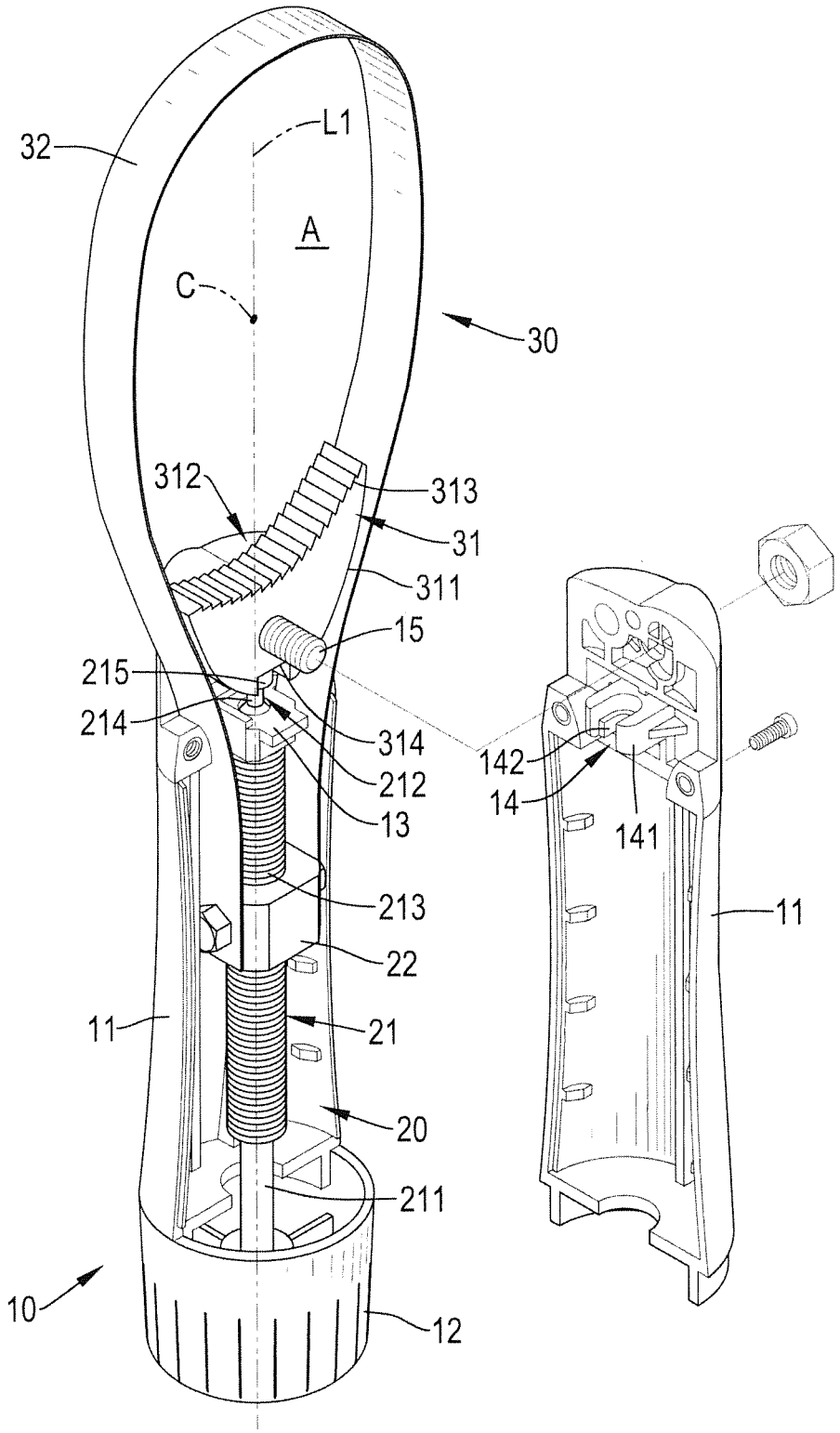
FIG. 2 is a partially exploded perspective view of the one-way drive strap wrench in FIG. 1.
Figure 3:
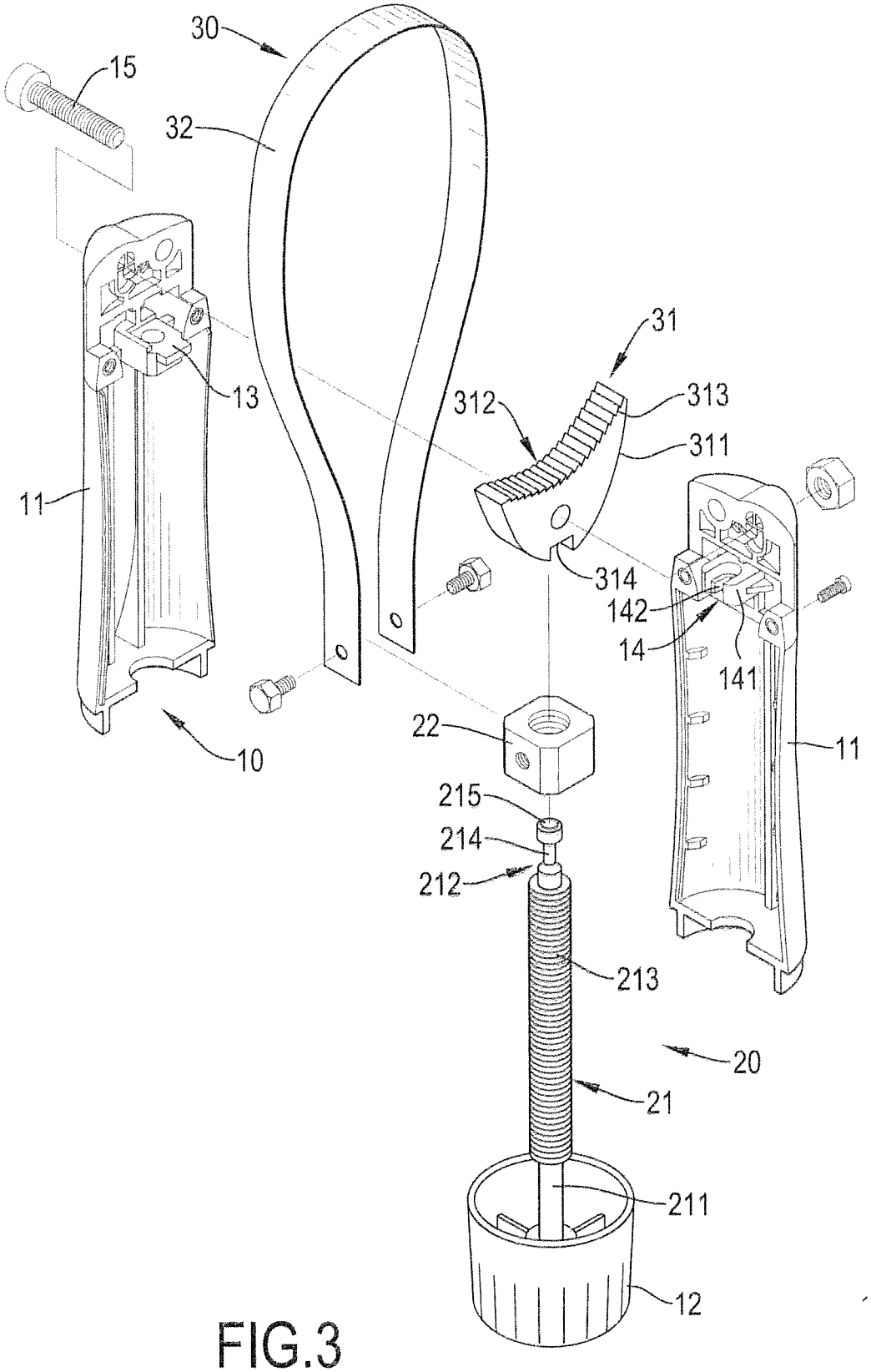
FIG. 3 is an exploded perspective view of the one-way drive strap wrench in FIG. 1.
Figure 4:
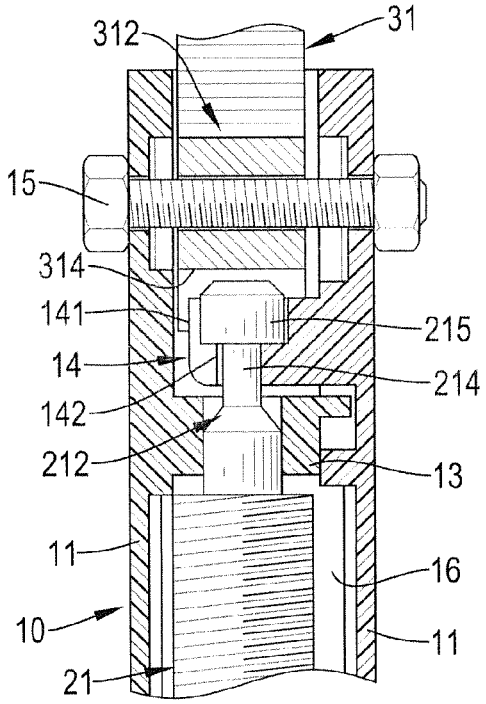
FIG. 4 is an enlarged side view in partial section of the one-way drive strap wrench along line 4-4 in FIG. 1.
Figure 5:
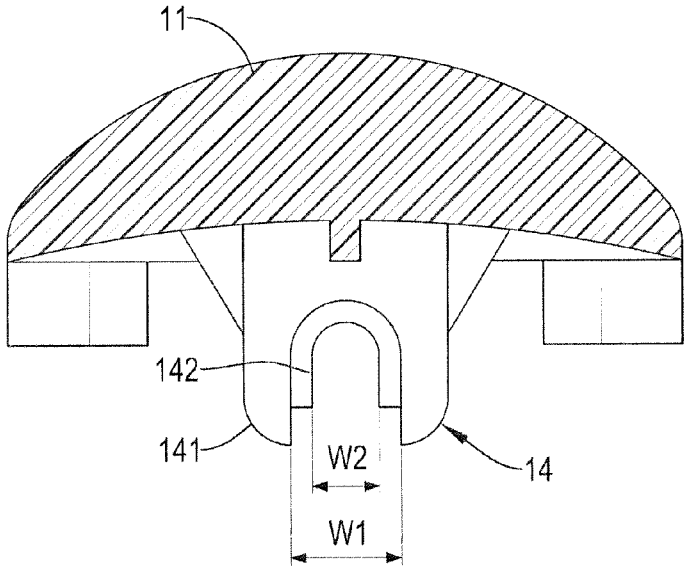
FIG. 5 is an enlarged top view in partial section of a mounting cover of the one-way drive strap wrench in FIG. 1.
Figure 6:
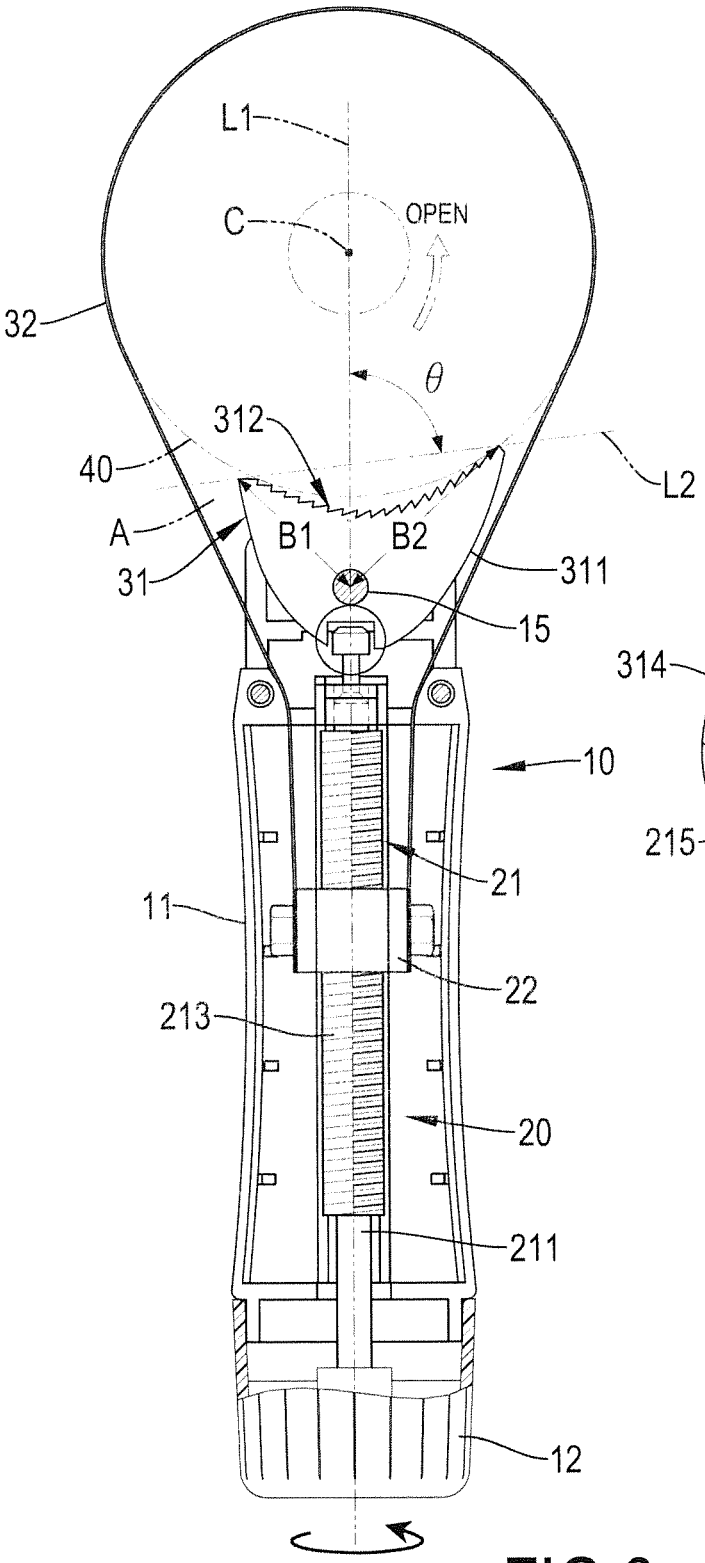
FIG. 6 shows operational front views in partial section of the one-way drive strap wrench in FIG. 1.
Figure 6A:
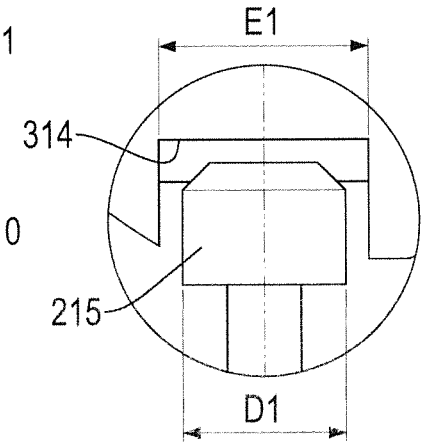
FIG. 6A shows enlarged front views of the one-way drive strap wrench in FIG. 6.

With reference to FIGS. 2, 6 and 6A, the clamping module 30 is detachably mounted on the handle 10 and the threaded rod module 20 and has a clamping block 31 and a strap 32. The clamping block 31 is an asymmetric meniscus, is deflectable mounted around the combining unit 15 and has a convex side 311, a concave side 312, multiple sawteeth 313, an accommodating trough 314, a first length B1, and a second length B2. The convex side 311 is convex and is adjacent to the pushing segment 212. The concave side 312 is concave and is opposite to the convex side 311. The sawteeth 313 are formed on the concave side 312. The accommodating trough 314 is formed in the convex side 312, accommodates the pushing segment 212, and selectively abuts the larger diameter segment 215 of the pushing segment 212. The accommodating trough 314 has a trough width E1 wider than the diameter D1 of the larger diameter segment 215, wherein the trough width E1 may be ranged from 1 mm to 1.5 mm wider than the diameter D1, and 1 mm is preferred.

The first length B1 is defined as a connection between a center of the combining unit 15 and an end of the concave side 312 (located at a left of the axis L1 in FIG. 6). The second length B2 is defined as a connection between the center of the combining unit 15 and the other end of the concave side 312 (located at a right of the axis L1 in FIG. 6), wherein the second length B2 is longer than the first length B1. The strap 32 is elongated and two ends of the strap 32 are combined with the nut 22. The strap 32 is circled around the clamping block 31, the fixing base 13 and the mounting cover 14, and a surrounded area A is formed between the concave side 312 of the clamping block 31 and the strap 32. The surrounded area A has a central point C located on the axis L1 of the handle 10. A blocking line L2 is defined as a connection that passes through the two ends of the concave side 312. A crossing angle θ is formed between the axis L1 and the blocking line L2 and is smaller than 90 degrees.

With reference to FIGS. 6 and 6A, the strap wrench is applied for an oil filter 40 of a motor vehicle. The strap 32 is mounted around the oil filter 40. Then, the operating knob 12 is rotated to rotate the rod body 21, such that the nut 22 can move along the rod body 21 via threads. The strap 32 moves with the nut 22 to clamp the oil filter 40 with the clamping block 31, wherein the clamping block 31 touches the oil filter 40 by two ends of the concave side 312, and the central point C is located at a center of the oil filter 40.

Figures 7, 7A:
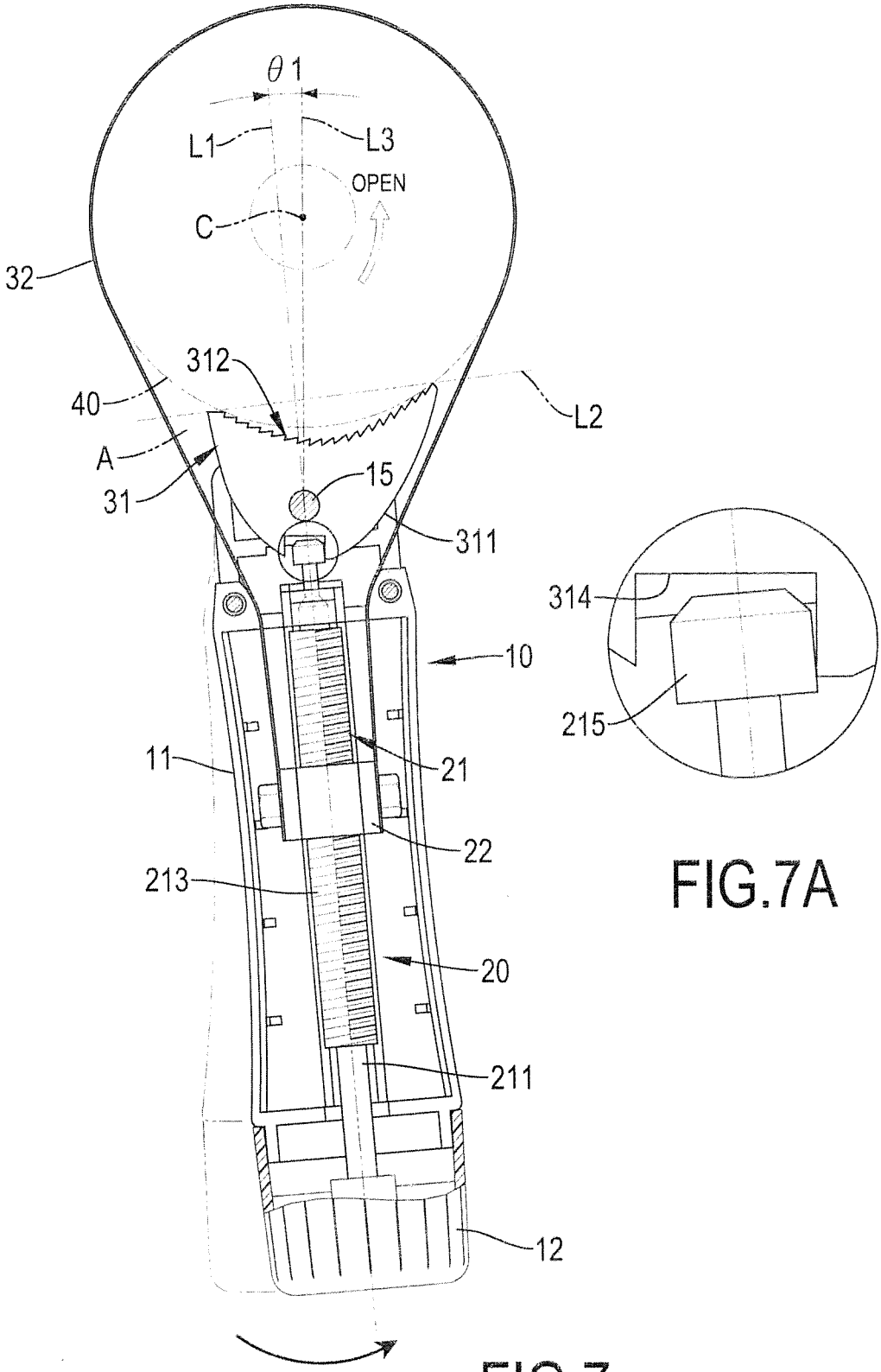
FIG. 7 shows operational front views in partial section of the one-way drive strap wrench in FIG. 1.
FIG. 7A shows enlarged front views of the one-way drive strap wrench in FIG. 7.

With reference to FIGS. 7 and 7A, when the handle 10 is pushed in a counterclockwise direction relative to the combining unit 15 as shown in the drawing, the axis L1 of the handle 10 is diverged from the central point C. A central connecting line L3 is defined as a connection that passes through the central point C and a center of the combining unit 15, wherein the axis L1 is located at a left of the central connecting line L3 in an upside of the center of the combining unit 15 as shown in FIG. 7. The larger diameter segment 215 is deflected relative to the accommodating trough 314 to touch the accommodating trough 314. Then, the clamping block 31 is pushed by the larger diameter segment 215. The oil filter 40 is further clamped tightly since the clamping block 31 is asymmetric and the second length B2 is longer than first length B1. A first angle θ 1 is formed between the axis L1 and the central connecting line L3

Figure 8:
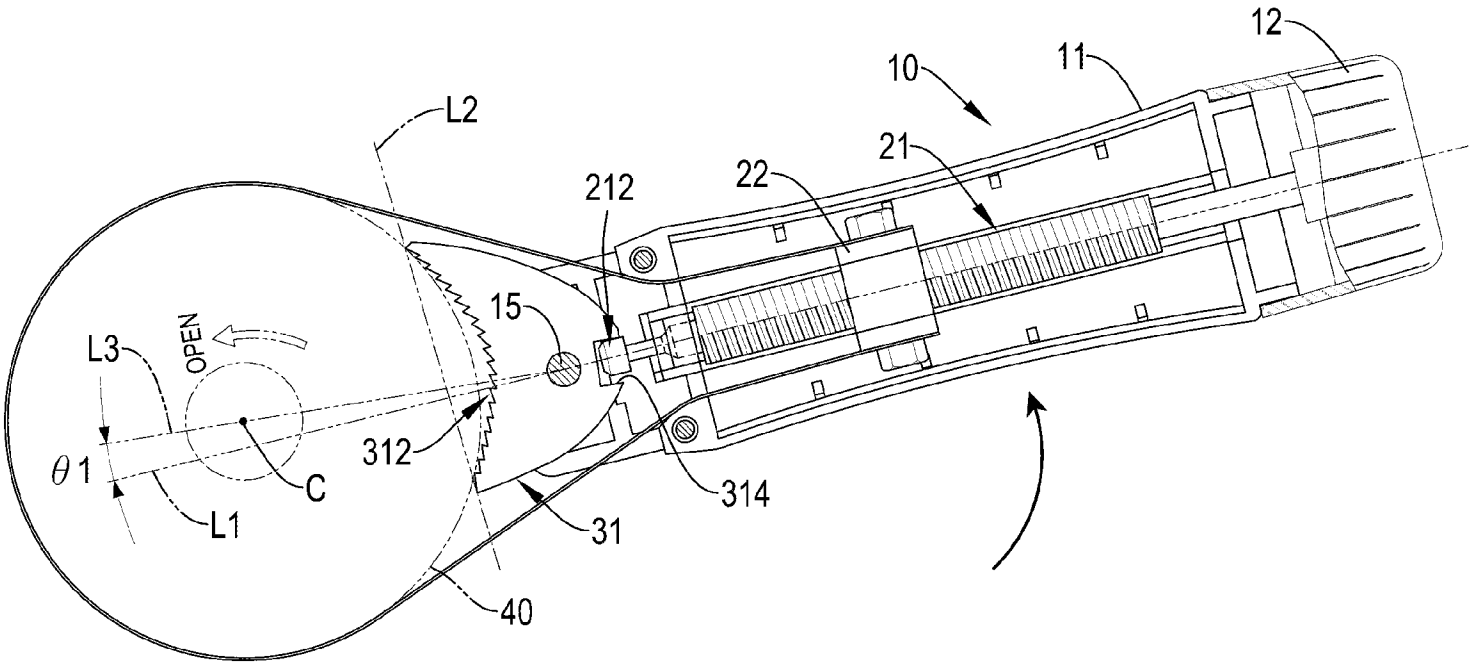
FIG. 8 shows operational front views in partial section of the one-way drive strap wrench in FIG. 1.

With reference to FIG. 8, when the handle 10 is further pushed in the counterclockwise direction, the oil filter 40 is rotated counterclockwise by the clamping block 31 and the strap 32 since the oil filter 40 is clamped tightly by the clamping block 31 and the strap 32.

Figures 9, 9A:
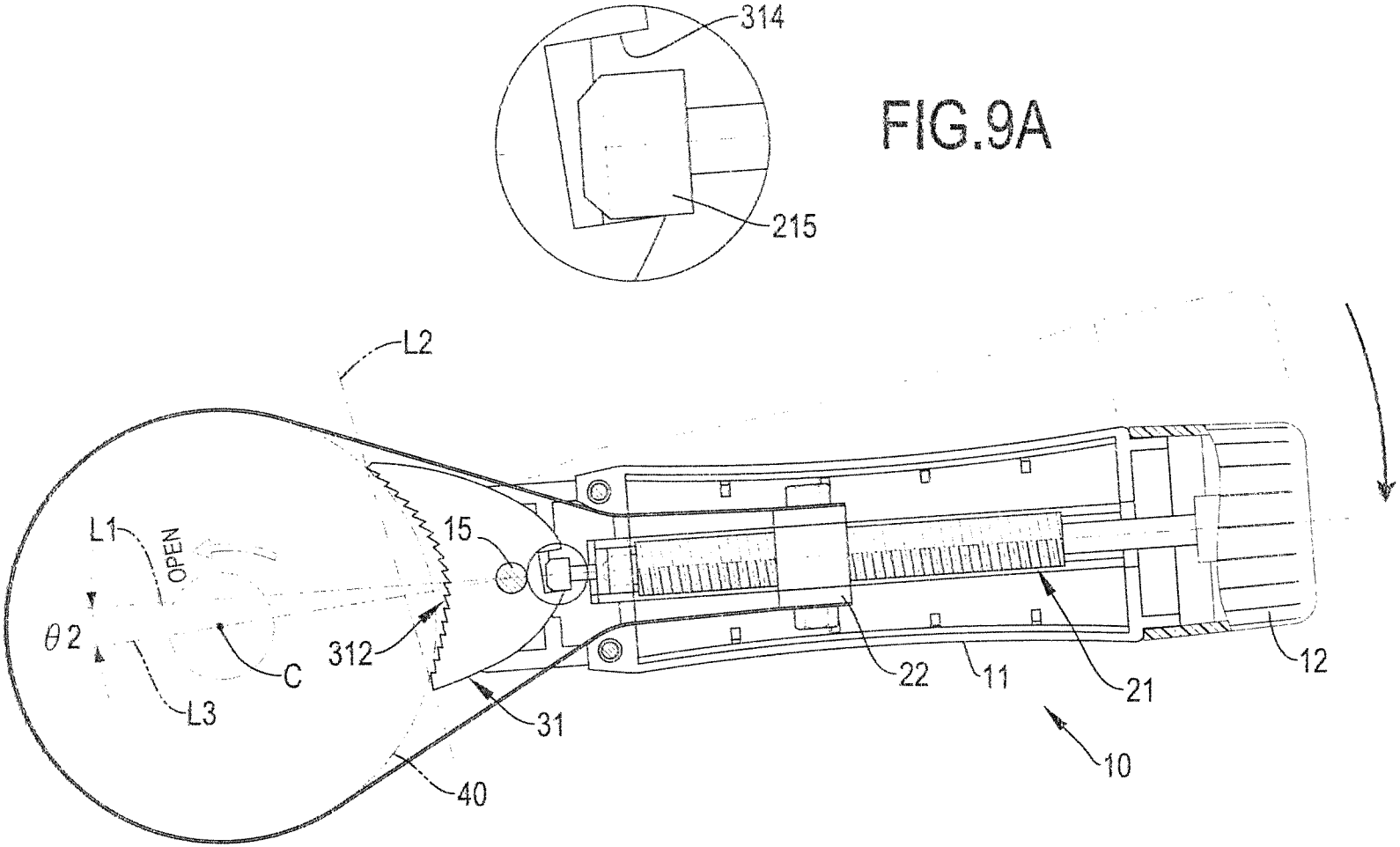
FIG. 9 shows operational front views in partial section of the one-way drive strap wrench in FIG. 1.
FIG. 9A shows enlarged front views of the one-way drive strap wrench in FIG. 9.
Figure 10:
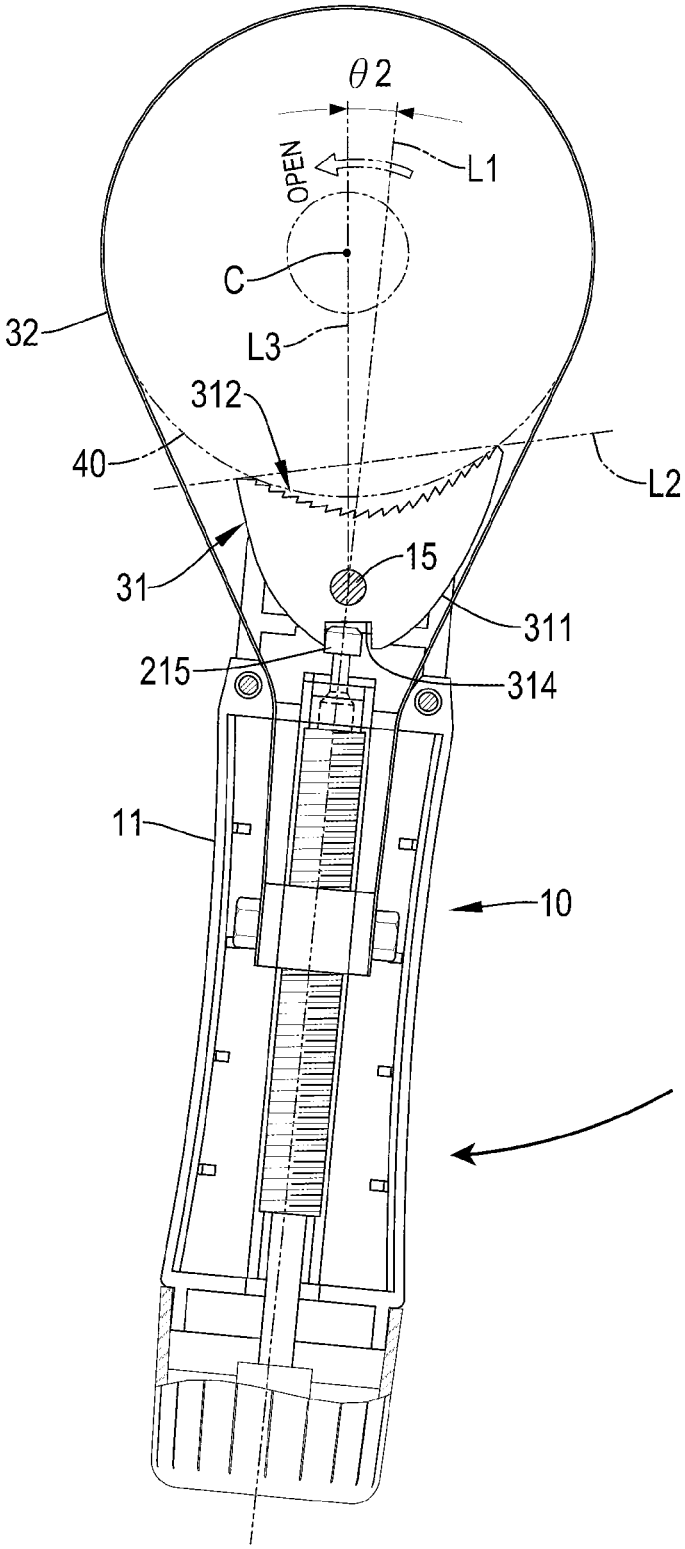
FIG. 10 shows operational front views in partial section of the one-way drive strap wrench in FIG. 1.

With reference to FIGS. 9, 9A and 10, after the oil filter 40 is rotated counterclockwise for an angle, the handle 10 may be limited by surrounding engine parts of the oil filter 40 in the motor vehicle. Then, the handle plates 11 are pivoted clockwise relative to the combining unit 15 until the larger diameter segment 215 abuts the accommodating trough 314, wherein the axis L1 is diverged to an upside of the central connecting line L3 in a left of the center of the combining unit 15 as shown in FIG. 9. Then, the clamping block 31 is pushed by the larger diameter segment 215. A second angle θ 2 is formed between the axis L1 and the central connecting line L3, wherein the second angle θ 2 is larger than the first angle θ 1 as described in FIGS. 7 and 7A. The oil filter 40 is loose clamped since the clamping block 31 is asymmetric and the first length B1 is shorter than the second length B2. Therefore, the strap wrench can be pivoted relative to the central point C to keep the oil filter 40 from rotating as shown in FIG. 10.

From the above description, it is noted that the present invention has the following advantages:

1. The oil filter 40 can be clamped tightly or loosen by pivoting the handle 10 relative to the combining unit 15 counterclockwise or clockwise. The structure of the clamping module 30 is simple, such that the cost and the working-time for manufacturing can be efficiently decreased.

2. The mounting cover 14 abuts the fixing base 13, the outer mounting portion 141 is mounted around the larger diameter segment 215, and the inner mounting portion 142 restricts the larger diameter segment 215, such that the rod body 21 can be kept from detaching from the handle plates 11 when being rotated by the operating knob 12.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A one-way drive strap wrench having: a handle being hollow and having an axis;

an operating knob rotatably mounted on an end of the handle; and a combining unit mounted on the handle and located at a position on the handle opposite to the operating knob;

a threaded rod module mounted in the handle and having a rod body being elongated, rotatably mounted in the handle and having a fixed segment mounted in the operating knob;

a pushing segment opposite to the fixed segment and having a diameter; and a threaded segment connected between the fixed segment and the pushing segment;

a nut moveably engaged with the threaded segment of the rod body via threads;

a clamping module mounted on the handle and the threaded rod module and having a clamping block being an asymmetric meniscus, deflectably mounted around the combining unit and having a convex side being convex and adjacent to the pushing segment;

a concave side being concave, opposite to the convex side and having two ends;

multiple sawteeth formed on the concave side;

a first length defined as a connection between a center of the combining unit and one end of the concave side;

a second length defined as a connection between the center of the combining unit and the other end of the concave side, wherein the second length is longer than the first length;

an accommodating trough formed in the convex side, accommodating the pushing segment, selectively abutting the pushing segment, and having a trough width wider than the diameter;

a strap combined with the nut, circled around the clamping block and having a surrounded area formed between the concave side of the clamping block and the strap, wherein the surrounded area has a central point;

a blocking line defined as a connection that passes through the two ends of the concave side; and a crossing angle formed between the axis of the handle and the blocking line and being smaller than 90 degrees.

2. The one-way drive strap wrench as claimed in claim 1, wherein the trough width is 1 mm to 1.5 mm wider than the diameter of the pushing segment.

3. The one-way drive strap wrench as claimed in claim 2, wherein the handle further has a fixing base mounted in the handle and mounted around the rod body.

4. The one-way drive strap wrench as claimed in claim 1, wherein the trough width is 1 mm wider than the diameter of the pushing segment.

5. The one-way drive strap wrench as claimed in claim 4, wherein the handle further has a fixing base mounted in the handle and mounted around the rod body.

6. The one-way drive strap wrench as claimed in claim 5, wherein the handle further has a mounting cover mounted in the handle, located at a side of the fixing base opposite to the operating knob, and mounted around and restricting the pushing segment of the rod body, wherein the mounting cover and the fixing base are mounted in the handle opposite to each other.

7. The one-way drive strap wrench as claimed in claim 6, wherein the mounting cover is U-shaped and further has an outer mounting portion mounted around the pushing segment; and an inner mounting portion protruding from an interior of the outer mounting portion; and the pushing segment further has a smaller diameter segment connected with the threaded segment and mounted in the inner mounting portion; and a larger diameter segment connected with the smaller diameter segment, mounted in the outer mounting portion and restricted by the inner mounting portion, wherein the diameter is formed in the larger diameter segment.

* * * * *